US006749332B2

(12) United States Patent
Murakami

(10) Patent No.: US 6,749,332 B2
(45) Date of Patent: Jun. 15, 2004

(54) MACHINE FOR STIRRING SOLDER IN LAMINATED TUBE, WITH TUBE ROTATION ABOUT HORIZONTAL AXES

(75) Inventor: Takehiko Murakami, Fuchu (JP)

(73) Assignee: Minami Co., Ltd., Tokyo (JP)

( * ) Notice: Subject to any disclaimer, the term of this patent is extended or adjusted under 35 U.S.C. 154(b) by 21 days.

(21) Appl. No.: 10/229,807

(22) Filed: Aug. 28, 2002

(65) Prior Publication Data

US 2003/0053370 A1 Mar. 20, 2003

(30) Foreign Application Priority Data

Sep. 17, 2001 (JP) ..... 2001-281272

(51) Int. Cl.[7] ..... B01F 9/02; B01F 9/22

(52) U.S. Cl. ..... 366/217

(58) Field of Search ..... 366/208–211, 213–214, 366/217, 219, 220, 235, 288; 494/31, 33

(56) References Cited

U.S. PATENT DOCUMENTS 2,937,814 A * 5/1960 Joisel ..... 241/175
3,591,098 A * 7/1971 McShirley ..... 241/137
4,148,590 A * 4/1979 Sotirianos ..... 366/288
5,314,125 A * 5/1994 Ohno ..... 241/175
2002/0119881 A1 * 8/2002 Wood ..... 494/33
2003/0053370 A1 * 3/2003 Murakami ..... 366/217

FOREIGN PATENT DOCUMENTS

GB 2070986 A * 9/1981
JP 3-193127 * 8/1991
JP 2003-80049 * 3/2003

* cited by examiner

*Primary Examiner*—Charles E. Cooley
(74) *Attorney, Agent, or Firm*—R. Neil Sudol; Henry D. Coleman; William J. Sapone

(57) ABSTRACT

To solve a problem of a height at a time of stirring a laminated tube solder by a conventional apparatus, makes it easy to keep balance at a time of rotating, and improve a stirring efficiency, a pair of circular supporting plates (7, 7) are fixed to portions near both end portions of a rotation driving shaft (2) which is horizontally supported to a stand (1), the rotation driving shaft (2) is rotated by a drive motor (3), four rotary tubes (8, 8) with opening and closing lids are supported between a pair of circular supporting plates (7, 7), and the rotary tubes (8, 8) are revolved around the rotation driving shaft (2) in a vertical direction while being made rotate around their own axes respectively.

2 Claims, 6 Drawing Sheets

MACHINE FOR STIRRING SOLDER IN LAMINATED TUBE, WITH TUBE ROTATION ABOUT HORIZONTAL AXES

BACKGROUND OF THE INVENTION

1. Field of the Invention

The present invention relates to a stirring machine for a laminated tube solder.

2. Conventional Art

In a screen printing machine, a solder is used as a printing agent, and, the solder is conventionally contained in a cup. Then, the solder charged in the cup by a maker is preserved in a refrigerator, and is stirred at a time of being used so as to be made soft from a solidified state.

Further, this stirring operation is executed by a stirring machine horizontally rotating the cup, or a laminated tube filled with the solder. In this case, a height of the cup is about 10 cm. However, a laminated tube solder as shown in FIG. 8 has been used recently. The laminated tube solder 100 is structured such that a solder 102 is charged into a laminated tube 101, and an adhesive tape 104 for sealing the tube 101 until being-it is used is attached to an outlet 103.

In the case of the laminated tube solder mentioned above, the entire length L thereof is about twice a length of the conventional cup. This is too long to be stirred by a conventional stirring machine which horizontally rotates a vertically placed cup. Furthermore, since the solder being charged may reach a weight of 500 g, it is difficult to maintain a proper balance in relation to centrifugal force when horizontally rotating the laminiated tube solder vertically placed.

SUMMARY OF THE INVENTION

The present invention is made by taking the points mentioned above into consideration, and an object of the present invention is to provide a stirring machine for a laminated tube solder structured such as to make a rotary tube with an opening and closing lid which receives the laminated tube solder revolve in a vertical direction while making the rotary tube rotate on its own axis in a horizontally tilted state, thereby solving the problems mentioned above and further improving a stirring efficiency.

Then, in accordance with an aspect of the present invention, there is provided a stirring machine for a laminated tube solder comprising:

a rotation driving shaft horizontally supported to a stand, the rotation driving shaft being rotated by a drive motor fixed to the stand;

a pair of circular supporting plates which is fixed to portions near both end portions of the rotation driving shaft in an axial direction in parallel; and a plurality of rotary tubes with opening and closing lids which are supported between the pair of circular supporting plates in such a manner as to symmetrically surround the rotation driving shaft, in which the rotary tubes with the opening and closing lids respectively rotate around their own axes via a desired driving mechanism.

Further, in the structure mentioned above, in accordance with a further particular structure, there is provided a stirring machine for a laminated tube solder comprising:

a stand;

a rotation driving shaft which is horizontally supported to the stand;

a drive motor which is fixed to the stand;

pulleys which are fixed to a rotary shaft of the drive motor and an end portion of the rotation driving shaft protruding out from the stand respectively;

a belt wound between these pulleys;

a pair of circular supporting plates which are fixed to portions near both end portions of the rotation driving shaft in an axial direction in parallel;

a plurality of rotary tubes with opening and closing lids which are supported between the pair of circular supporting plates in such a manner as to symmetrically surround the rotation driving shaft, and have shaft portions in end portions in the side of the pulleys respectively protruded out from the circular supporting plate;

pulleys which are fixed to the shaft portions of the rotary tubes with the opening and closing lids protruding out from the circular supporting plate;

a belt which is wound between the pulleys;

pulleys which are fixed to the shaft portion of one rotary tube with the opening and closing lid among a plurality of rotary tubes with the opening and closing lids and to a portion of the rotation driving shaft in the inner side of the stand respectively; and a belt which is wound between the pulleys.

DESCRIPTION OF THE PREFERRED EMBODIMENT

A description will be given of an embodiment in accordance with the present invention with reference to the accompanying drawings.

Figure 1:
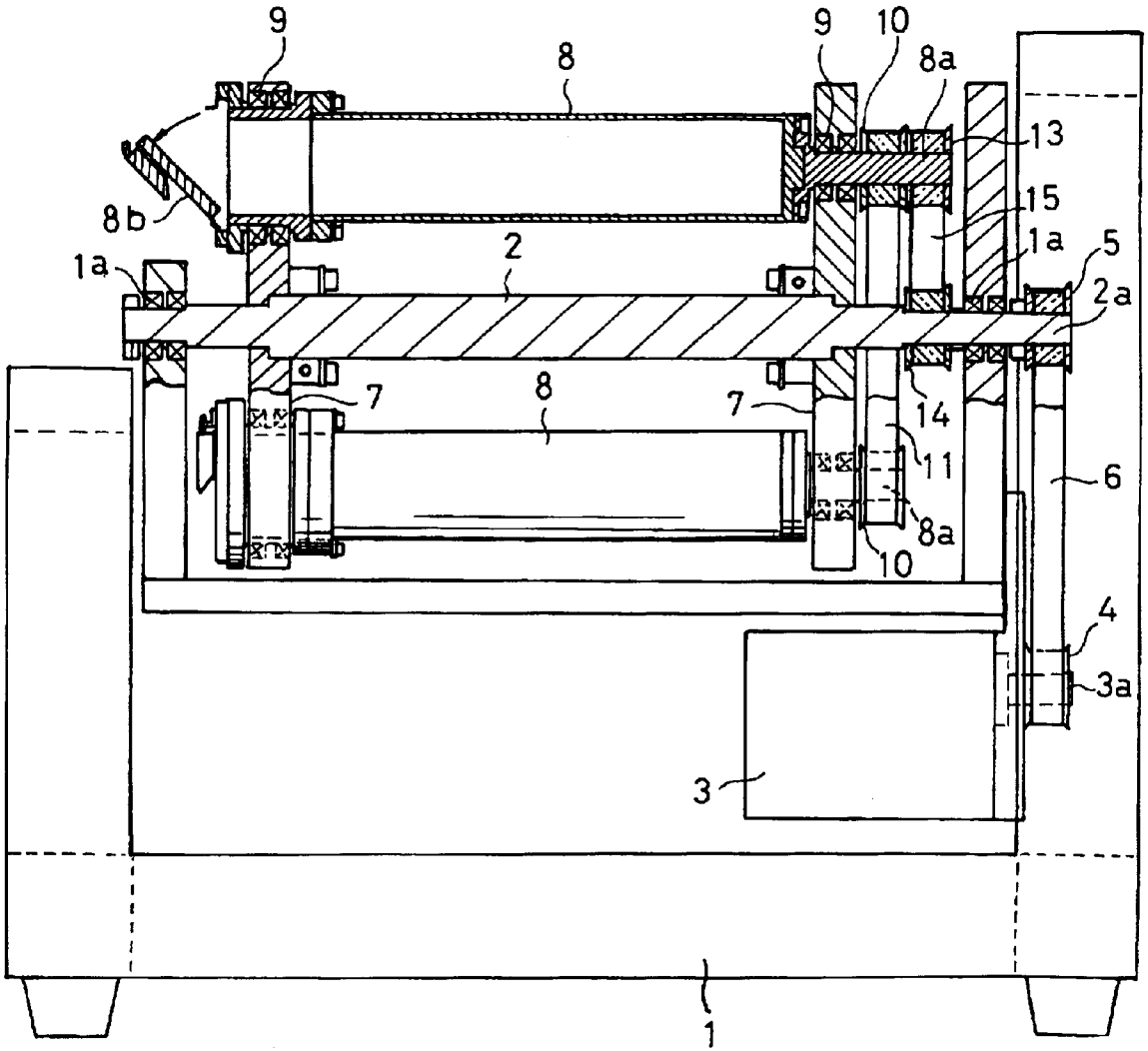
FIG. 1 is a front view of a stirring machine in accordance with the present invention with a partly cross sectional view.
Figure 2:
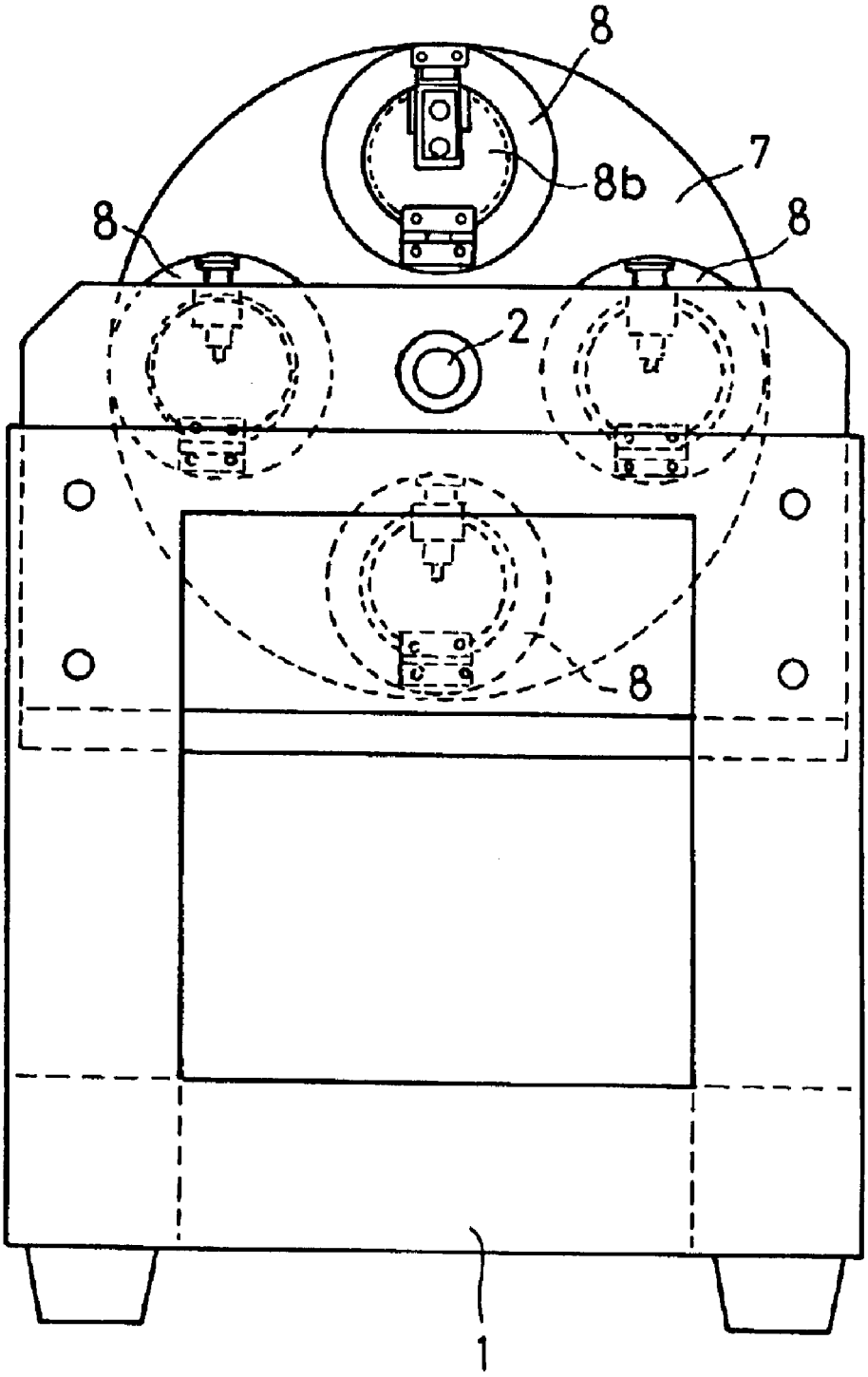
FIG. 2 is a left side elevational view of the stirring machine of the present invention.
Figure 3:
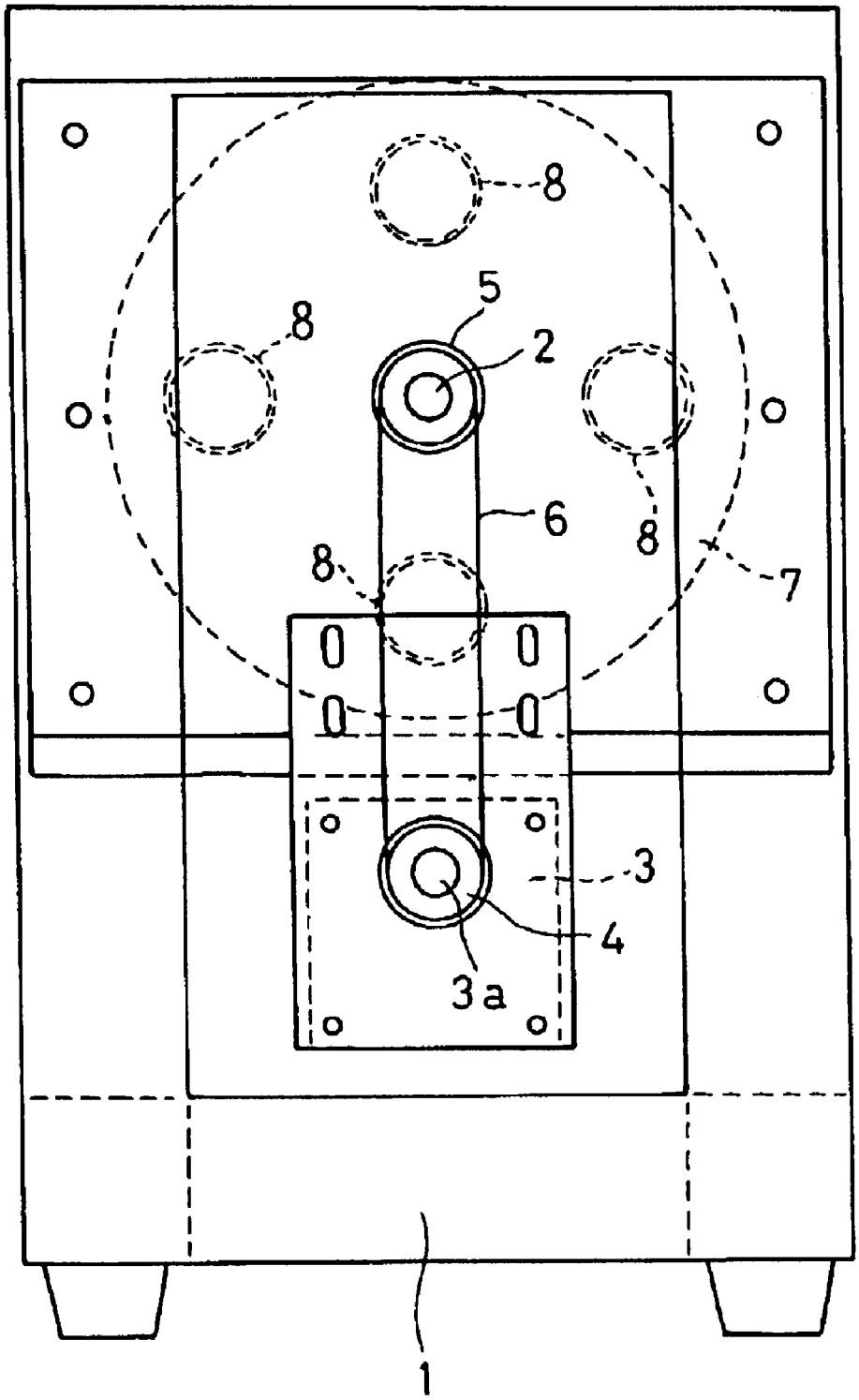
FIG. 3 is a right side elevational view of the stirring machine of the present invention.
Figure 4:
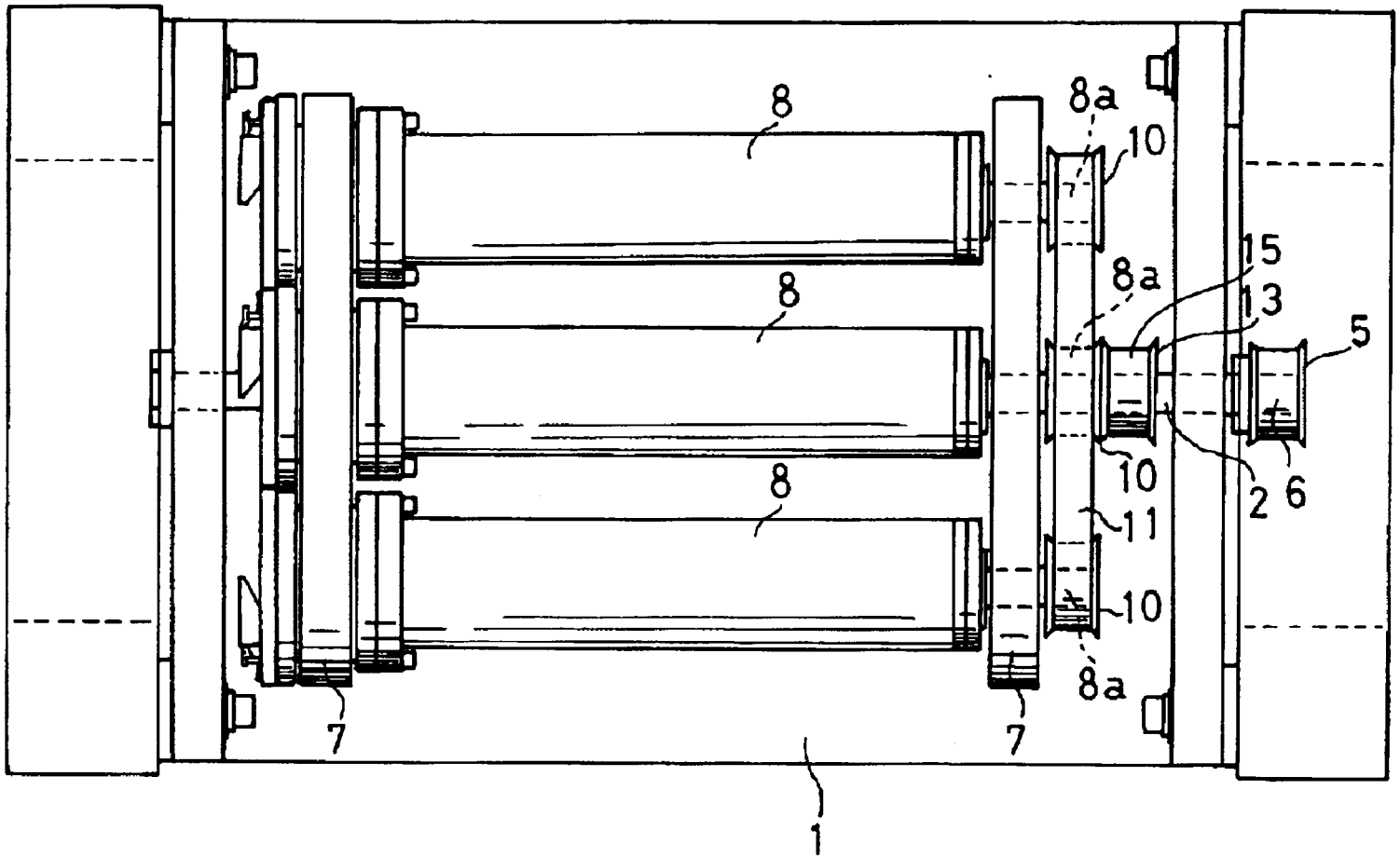
FIG. 4 is a plan view of the stirring machine of the present invention.
Figure 5:
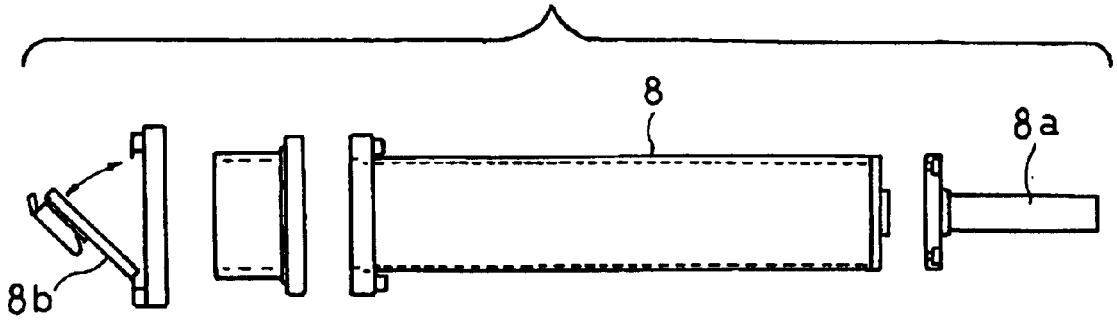
FIG. 5 is an exploded front elevational view of a state in which a rotary tube with a lid included in the stirring machine of the present invention.
Figure 6:
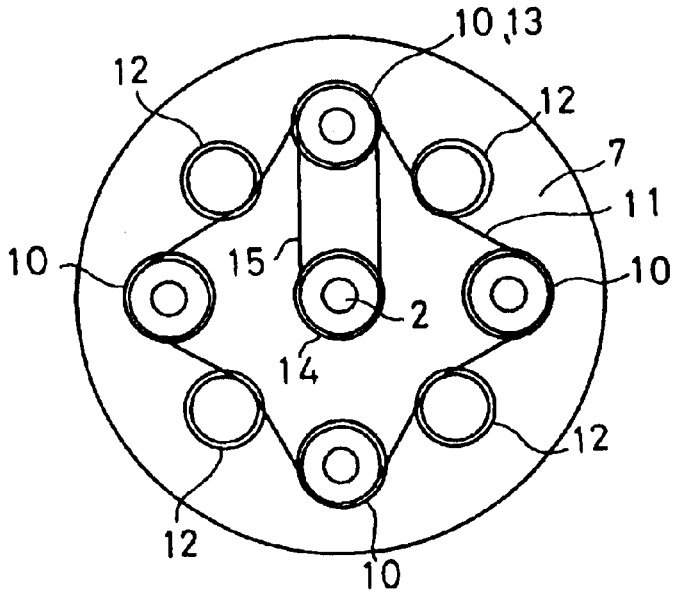
FIG. 6 is a schematic view, taken in a vertical plane perpendicular to the plane of the paper in FIG. 1, which illustrates an operation of the present invention.
Figure 7:
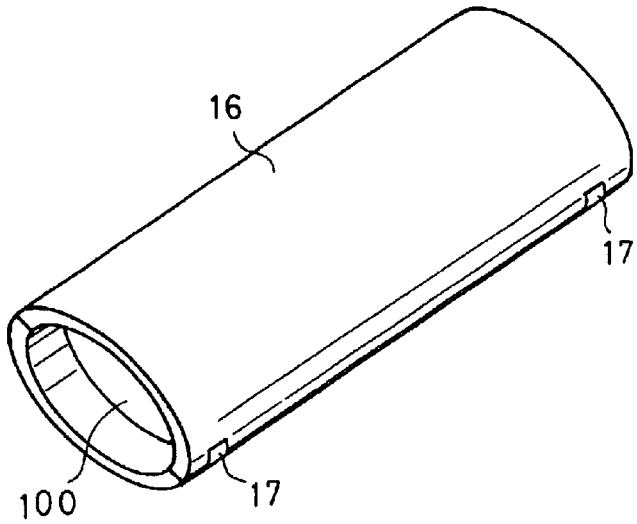
FIG. 7 is a perspective view of an auxiliary tube utilizable with the rotary tube of FIG. 5.
Figure 8:
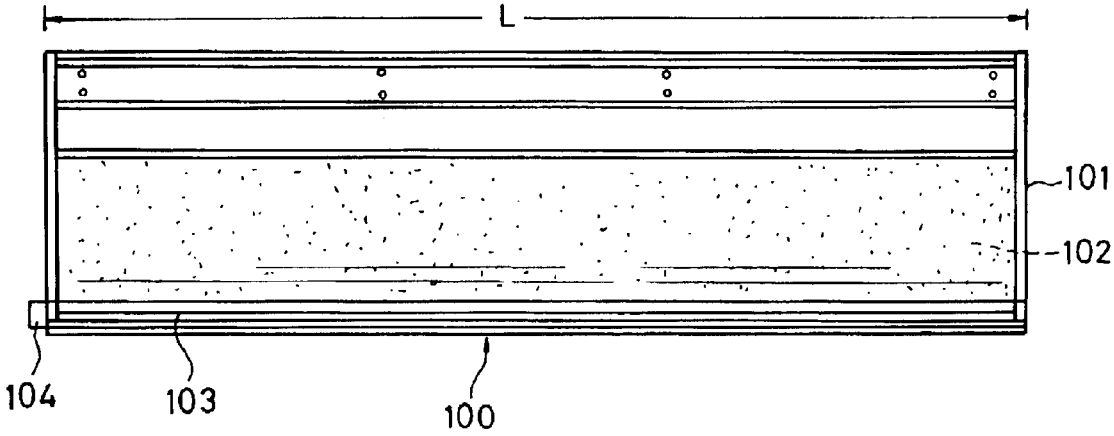
FIG. 8 is a schematic view of a laminated tube solder that is rotated about two horizontal axes in the stirring machine of FIGS. 1–4.

FIG. 1 is a front view of a stirring machine in accordance with the present invention, partly in cross sectional, FIG. 2 is a left side view of the stirring machine of FIG. 1, FIG. 3 is a right side view of the stirring machine of FIGS. 1 and 2, FIG. 4 is a plan view of the stirring machine of FIGS. 1–3, FIG. 5 is a front exploded view of a state in which a rotary tube with an alternately openable and closable lid, FIG. 6 is a schematic view which depicts an operation of a tension pulley arrangement of the stirring machine of the present invention, FIG. 7 is a perspective view of an auxiliary tube used in the stirring machine, and FIG. 8 is a schematic view of a laminated tube solder for mixing by a stirring machine in accordance with the present invention.

In the drawings, reference numeral 1 denotes a stand. In this case, in the drawings, a cover is omitted. Further, reference symbol 1*a* denotes a bearing for rotatably supporting a rotation driving shaft mentioned below. Reference numeral 2 denotes a rotation driving shaft which is horizontally supported to the stand 1. Further, the rotation driving shaft 2 is protruded out from the stand 1 at one end thereof. In this case, reference symbol 2*a* denotes a protruding portion.

Reference numeral 3 denotes a drive motor which is fixed to the stand 1. The drive motor 3 constitutes a rotation driving source for the rotation driving shaft 2. In FIG. 1 and FIG. 3, reference numeral 4 denotes a pulley which is fixed to a rotary shaft 3*a* of the drive motor 3, reference numeral 5 denotes a pulley which is fixed to the end portion 2*a* of the rotation driving shaft 2 protruding out from the stand 1, and reference numeral 6 denotes a belt which is wound between and partially around each of the pulleys 4 and 5.

Reference numerals 7 denote a pair of circular supporting plates which are fixed parallel end portions of the rotation driving shaft 2. Reference numerals 8 denote rotary tubes with alternately openable and closable lids 8*b* which are supported between circular supporting plates 7 so as to symmetrically surround the rotation driving shaft 2, the rotary tubes 8 having shaft portions 8*a* in end portions in on the same side of the machine as the pulleys 4 and 5, the shaft portions protruding from the circular supporting plates 7. Furthermore, in the present embodiment, the number of the rotary tubes four, however, the number may be made greater or less than four. In addition, the rotary tubes 8 are rotatably supported in the pair of circular supporting plates 7 via bearings 9, respectively.

Reference numerals 10 denote pulleys which are fixed to the shaft portions 8*a* of the rotary tubes 8 protruding out from the circular supporting plate 7, and reference numeral 11 denotes a belt which is wound partially around each of the pulleys 10. Reference numerals 12 shown in FIG. 6 denote tension pulleys which are provided on the circular supporting plate 7.

Reference numeral 13 denotes a pulley which is fixed to the shaft portion of one rotary tube with the opening and closing lid among a plurality of rotary tubes 8 and 8 with the opening and closing lids, reference numeral 14 denotes a pulley which is fixed to an inner portion of the rotation driving shaft 2 in an inner side of the stand 1, and reference numeral 15 denotes a belt which is wound between the pulleys 13 and 14.

As shown in FIG. 7, reference numeral 16 denotes an auxiliary tube which is used at a time when the laminated tube solder is received within a rotary tube. Further, the auxiliary tube 16 is made of an expanded polystyrene or the like, and can be freely opened and closed via a hinge 17.

Next, a description will be given of an operation of the present invention.

The laminated tube solder is inserted to the auxiliary tube 16 and then is received within the rotary tube 8 with the opening and closing lid. When operating the drive motor 3 under this state, the rotation driving shaft 2 rotates via the pulleys 4 and 5 and the belt 6. Then, a pair of circular supporting plates 7 and 7 are accordingly rotated, and a plurality of (four) rotary tubes 8 and 8 with the opening and closing lids which are supported between the plates are rotated around the rotation driving shaft 2. Accordingly, the rotary tubes 8 and 8 with the opening and closing lids revolve around the rotation driving shaft 2 in a vertical direction. Further, the shaft portion of one rotary tube with the opening and closing lid among a plurality of rotary tubes 8 and 8 with the opening and closing lids is simultaneously rotated via the pulleys 13 and 14 and the belt 15. Then, all of the rotary tubes 8 and 8 with the opening and closing lids rotate around their own axes by the pulleys 10 and 10 which are fixed to the shaft portions 8*a* in all of the rotary tubes 8 and 8 with the opening and closing lids, and the belt 11 which is wound around the pulleys 10 and 10. Therefore, the laminated tube solder received within the four rotary tubes 8 and 8 with the opening and closing lids can be stirred.

Since the present invention has the structure and operation as described above, it is possible to revolve the rotary tubes 8, which receive the laminated tube solder, around the rotation driving shaft 2 in a vertical direction as they rotate around their own axes while in state of being horizontally oriented. Accordingly, it is possible to solve the problem related to increased height due to increased length of the tube or cup, and it is easy to maintain proper balance during the rotation process. In addition, the present invention improves the efficiency of the stirring process.

What is claimed is:

1. A stirring machine for a laminated tube solder, comprising:

a stand;

a rotation driving shaft which is horizontally supported on said stand;

a drive motor which is fixed to said stand;

a first drive pulley which is fixed to a rotary shaft of said drive motor;

a first driven pulley which is fixed to an end portion of said rotation driving shaft protruding out from said stand;

a first drive belt for revolution wound partially about aid first drive pulley and said first driven pulley;

a pair of circular supporting plates which are fixed to portions near opposite end portions of said rotation driving shaft and arranged axially in parallel with one another;

a plurality of rotary tubes which are arranged between said pair of circular supporting plates in parallel with said rotation driving shaft, and supported rotatably to said rotation driving shaft, a shaft portion of each of said rotary tubes being protruded from one of said circular supporting plates at the side of said first driven pulley, each rotary tube being provided with an alternately openable and closable lid at an end opposite said first driven pulley;

rotary tube rotation pulleys, each of which is fixed to the shaft portion of a respective one of said rotary tubes protruding out from said circular supporting plate;

a second drive belt for rotation of said rotary tubes, said second drive belt being partially wound about each of said rotary tube rotation pulleys;

a second drive pulley which is fixed to said rotation driving shaft on a same side thereof as said first driven pulley, and on a side of said stand opposite said first driven pulley;

a second driven pulley which is fixed to the shaft portion of one of said rotary tubes; and a third drive belt for rotation wound about said second drive pulley and said second driven pulley.

2. A stirring machine for a laminated tube solder comprising;

a stand;

a rotation driving shaft mounted in a substantially horizontal orientation to said stand, said rotation driving shaft having an end portion protruding out from said stand;

a drive motor fixed to said stand, said drive motor having a rotary shaft;

a first drive pulley fixed to said rotary shaft;

a first driven pulley fixed to said protruding end portion of said rotation driving shaft, said first driven pulley being located on one side of said stand;

a first drive belt wound partially about said first drive pulley and said first driven pulley;

a pair of circular supporting plates fixed to said rotation driving shaft near opposite ends thereof, said circular supporting plates being arranged in parallel with one another;

a plurality of rotary tubes disposed between said circular supporting plates in parallel with said rotation driving shaft for rotation about an axis of said rotation driving shaft, said rotary tubes rotatably mounted to said circular supporting plates for rotation about respective horizontal axes parallel to and spaced from said rotation driving shaft, a shaft portion of each of said rotary tubes protruding from one of said circular supporting plates on said one side of said stand, said rotary tubes each being provided with an alternately openable and closable lid at an end opposite said one side of said stand;

rotary tube rotation pulleys each fixed to the protruding shaft portion of a respective one of said rotary tubes;

a second drive belt partially wound about said rotary tube rotation pulleys;

a second driving pulley fixed to said rotation driving shaft;

a second driven pulley fixed to the protruding shaft portion of one of said rotary tubes; and a third drive belt partially wound about said second driving pulley and said second driven pulley.

* * * * *